US006345883B1

(12) United States Patent
Shin et al.

(10) Patent No.: US 6,345,883 B1
(45) Date of Patent: Feb. 12, 2002

(54) INK JETTING APPARATUS WITH FINS

(75) Inventors: Su-Ho Shin; Yong-Ung Ha, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/663,685

(22) Filed: Sep. 19, 2000

(30) Foreign Application Priority Data

Nov. 4, 1999 (KR) ..... 99-48554

(51) Int. Cl.[7] ..... B41J 2/04
(52) U.S. Cl. ..... 347/54
(58) Field of Search ..... 347/54, 68, 70, 347/71, 72, 50, 40, 12, 59, 62, 13; 399/261; 361/700; 310/328–330; 29/890.1

(56) References Cited

U.S. PATENT DOCUMENTS 5,666,140 A * 9/1997 Mitani et al.

* cited by examiner

*Primary Examiner*—Raquel Yvette Gordon
(74) *Attorney, Agent, or Firm*—Robert E. Bushnell, Esq.

(57) ABSTRACT

An ink jetting apparatus includes a nozzle module, a driving module, and a membrane. The nozzle module includes an ink chamber for reserving ink, and a nozzle hole for permitting ink in the ink chamber to be jetted therethrough. The driving module includes a working fluid chamber charged with working fluid, a heater disposed in the working fluid chamber, and a plurality of fins fixed to the heater, which are heated by the heater. By pressure from a bubble produced during the heating of the working fluid chamber by the heater, the membrane is curved into the ink chamber, and ink in the ink chamber is jetted through the nozzle hole. Since the bubble is divided by a plurality of fins on the heater, the bubbles disappear rapidly when the heater stops heating. Accordingly, the high-speed operation of the ink jetting apparatus becomes possible, and the ink jetting apparatus is more stably driven.

14 Claims, 8 Drawing Sheets

INK JETTING APPARATUS WITH FINS

CLAIM OF PRIORITY

This application makes reference to, incorporates the same herein, and claims all benefits accruing under 35 U.S.C. §119 from the inventor's application THERMAL-COMPRESS TYPE INK JETTING APPARATUS filed with the Korean Industrial Property Office on Nov. 4, 1999 and there duly assigned Ser. No. 48554/1999.

BACKGROUND OF THE INVENTION

1. Field of the Invention

The present invention relates to an output apparatus such as an inkjet printer, or facsimile machine, etc., and more particularly to a thermal-compression type fluid jetting apparatus employed in a printer head of an output apparatus.

2. Description of the Prior Art

Generally, a fluid jetting apparatus employed in a printer head of an output apparatus such as an inkjet printer or a facsimile machine, etc., ejects ink in an ink chamber outward through a nozzle by exerting physical force to the ink chamber. Such a fluid jetting apparatus may be of a thermal type, a piezoelectric type, or a thermal-compression type in accordance with the method of exerting physical force on the fluid.

One example of a thermal-compression type fluid jetting apparatus is shown in FIG. 1. The fluid jetting apparatus includes a driving module 20, a membrane 30, and a nozzle module 40.

The driving module includes a substrate 15, an oxide film 14 laminated on substrate 15, a working fluid barrier 25 having a working fluid chamber 27, a heater 16 disposed in working fluid chamber 27, and a conductor 17 connected with heater 16.

The nozzle module includes an ink chamber barrier 45 having an ink chamber 57, and a nozzle plate 47 connected with the upper portion of ink chamber barrier 45. On the upper side of nozzle plate 47, a nozzle hole 49 is formed to permit ink in ink chamber 57 to be jetted therethrough.

The membrane is located between ink chamber barrier 45 and working fluid barrier 25. The membrane serves as a partition between the working fluid chamber and the ink chamber.

The working fluid such as a heptane or the like, is charged in working fluid chamber 27, while ink is constantly fed into ink chamber 57 from an ink source (which is not shown in the drawings).

FIGS. 2 and 3 show an operating process of a conventional ink jetting apparatus of FIG. 1. As electricity is applied to conductor 17, heat is generated from heater 16, and working fluid in working fluid chamber 27 is heated, forming bubbles. The bubbles cause pressure in working fluid chamber 27 to increase. Accordingly, membrane 30 is upwardly expanded, pressuring ink in ink chamber 57. Accordingly, the ink in ink chamber 57 is jetted through nozzle holes 49.

Then, as the electricity supply to heater 16 is ceased, as shown in FIG. 3, bubbles B contract. Accordingly, membrane 30 recovers its initial shape, and pressure in ink chamber 57 is decreased. The ink expressed outward through nozzle hole 49 is separated from the ink in the form of an ink drop I, and is jetted out of ink chamber 57. In this way, ink jetting is performed by the repetitious heating operation of heater 16.

Bubbles B are produced by the heat energy at different temperatures depending on the material type used as the working fluid. For example, according to the Homogeneous Nucleation theory, heptane produces bubbles at the temperature of 214° C., while water produces bubbles at the temperature of 270–310° C. In order to perform a repetitious printing operation, heater 16 of the ink jetting apparatus undergoes numerous heating and cooling processes, which means that the high cooling speed of heater 16 determines the high quality of the ink jetting apparatus.

In a conventional ink jetting apparatus, when heater 16 begins the heating operation, the bubble B is produced instantly, and covers the whole area of the heater 16 as shown in FIG. 2. Here, since a bubble B has low heat conductivity, when the electricity supply to heater 16 is ceased, bubble B contracts from the farthest area from where the bubble is in contact with heater 16. Accordingly, it takes a longer time for bubble B to disappear than to be produced, and the ink jetting apparatus can not be operated rapidly. In the event that heater 16 re-starts the heating operation before the complete disappearance of bubble B, the pressure control in working fluid chamber 27 is disturbed by the presence of bubble B, and the stability in driving the ink jetting apparatus deteriorates.

SUMMARY OF THE INVENTION

Accordingly, an object of the present invention is to provide an ink jetting apparatus capable of performing high-speed printing operations by providing for rapid disappearance of the bubbles during the heating operation of the heater.

The above object is accomplished by a thermal-compression type ink jetting apparatus according to the present invention, including: a nozzle module having an ink chamber for reserving ink, and a nozzle hole for permitting ink in the ink chamber to be jetted therethrough; a driving module having a working fluid chamber charged with the working fluid, a heater disposed in the working fluid chamber, a conductor for supplying electricity to the heater from an external power source, and at least one fin located on the heater and heated by the heater; and a membrane serving as a partition between the ink chamber and the working fluid chamber, the membrane being curved into the ink chamber by the pressure of a bubble which is produced while heating the working fluid to jet the ink in the ink chamber through a nozzle hole.

The fins are in the shape of plates, and are arranged on the heater in a parallel, or latticed arrangement. Preferably, the fins have a height of less than 70% of distance between the heater and the membrane, and are made of metal such as aluminum, copper, nickel, silver, or gold.

According to the present invention, since the bubbles are divided by a plurality of fins located on the heater, they disappear rapidly. As a result, high-speed driving of the ink jetting apparatus becomes possible, and stable driving of the ink jetting apparatus is performed.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF THE PREFERRED EMBODIMENTS

The present invention will be described in greater detail with reference to the 44, accompanying drawings.

Figure 1:
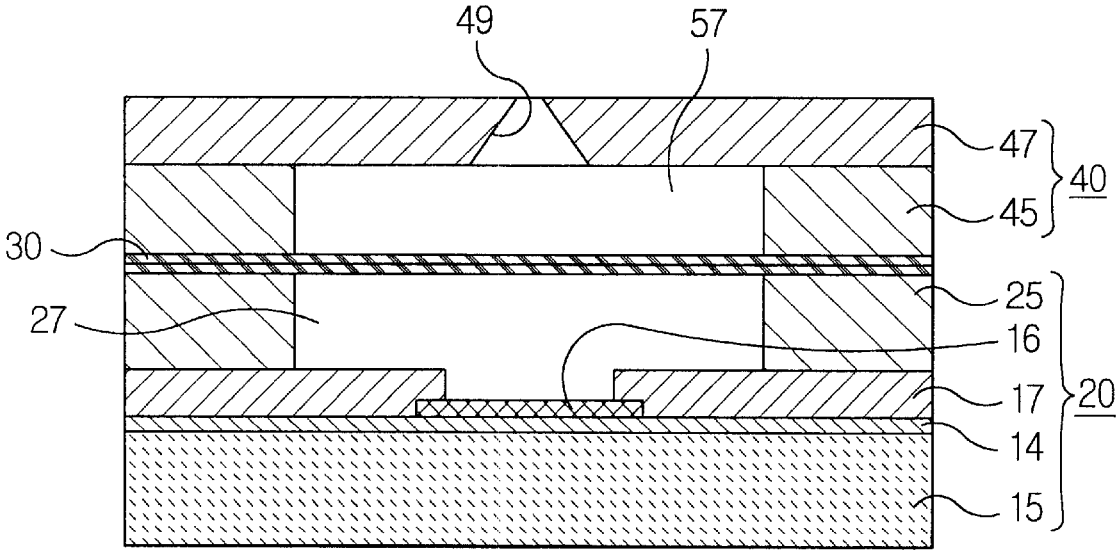
FIG. 1 (PRIOR ART)
FIG. 1 is a sectional view of a conventional ink jetting apparatus.
Figure 2:
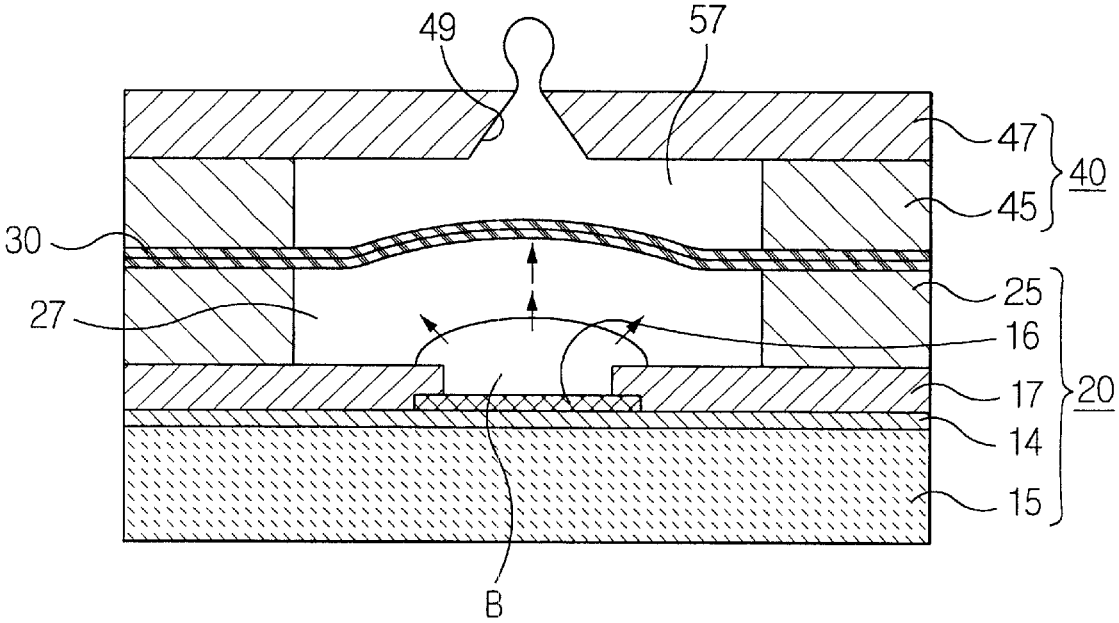
FIG. 2 (PRIOR ART)
FIGS. 2 and 3 are views for explaining the operation of the ink jetting apparatus shown in FIG. 1.
Figure 3:
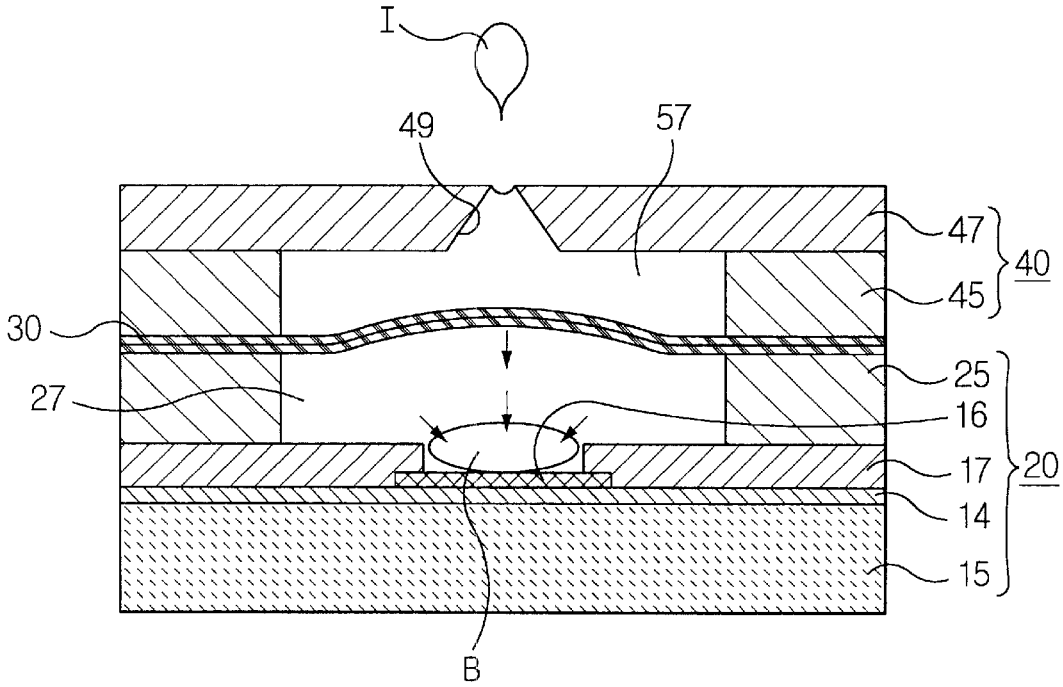
FIG.3 (PRIOR ART)
Figure 4:
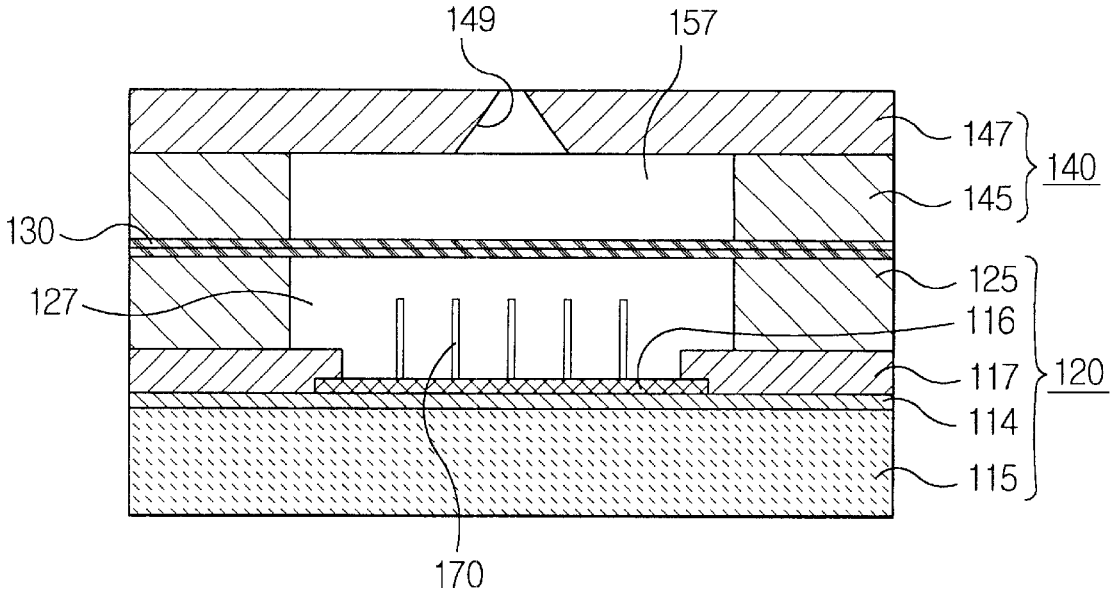
FIG. 4 is a sectional view of an ink jetting apparatus according to the present invention.

FIG. 4 is a sectional view of an ink jetting apparatus according to the present invention. Referring to FIG. 4, the ink jetting apparatus according to the present invention includes a driving module 120, a membrane 130, and a nozzle module 140.

The nozzle module includes an ink chamber barrier 145 having an ink chamber 157, and a nozzle plate 147 connected with the upper side of the ink chamber barrier 145. The nozzle plate has a nozzle hole 149 bored therein. At one side of ink chamber 157, an ink feeding hole (not shown) is bored and connected with an external ink source (not shown). Through the ink feeding hole, the ink is fed into ink chamber 157 from the external ink source and ink is charged into ink chamber 157, accordingly.

The driving module includes a substrate 115, an oxide film 114 laminated on the substrate 115, a working fluid barrier 125 having a working fluid chamber 127, a heater 116 located in the working fluid barrier 125, and a conductor 117 connected with an external power source for supplying electricity to heater 116. The working fluid chamber is charged with working fluid. Heptane, water, ethanol, and hexane are used, or ink fed into ink chamber 157 can be used as working fluid.

The membrane is located between ink chamber barrier 145 and working fluid barrier 125. The membrane serves as a partition between working fluid chamber 127 and ink chamber 157.

On heater 116, a plurality of plate-shaped fins 170 are disposed. The fins are made of a metal having high heat conductivity such as aluminum, copper, nickel, silver, or gold, etc. As will be described later, fins 170 function to divide the bubble formative area into a plurality of areas, and also to cause the bubbles to vanish rapidly.

Figure 5:
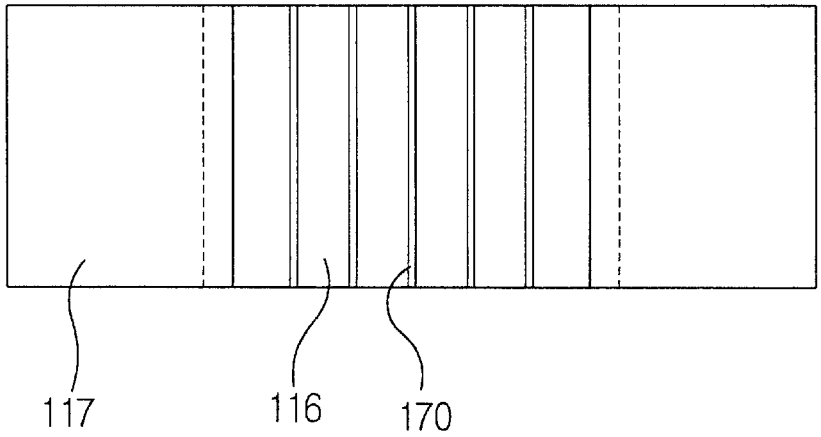
FIGS. 5 to 7 are plan views of FIG. 4 for showing various embodiments of the present invention.
Figure 6:
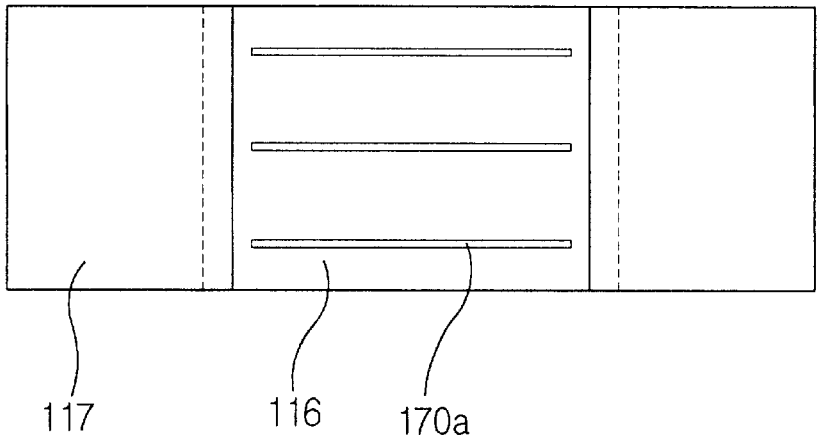
Figure 7:
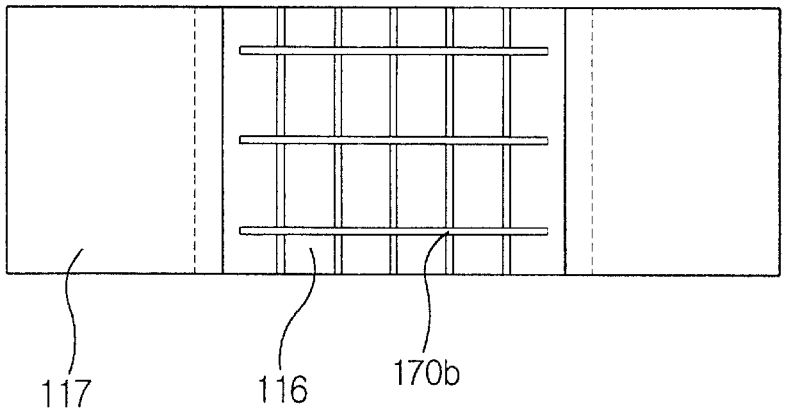

FIGS. 5 to 7 are plan views of the apparatus of FIG. 4, showing various arrangements of fins 170 on the heater 116, according to various embodiments of the invention. FIG. 5 shows a vertical arrangement of the parallel fins 170*a*, FIG. 6 shows a horizontal arrangement of parallel fins 170*b*, and FIG. 7 shows a latticed arrangement of fins 170*c*. When fins 170*b* and 170*c* are arranged as shown in FIGS. 6 and 7, the respective ends of fins 170*b* and 170*c* are spaced from conductor 117 at a certain distance in order to avoid contact with conductor 117.

Figure 8:
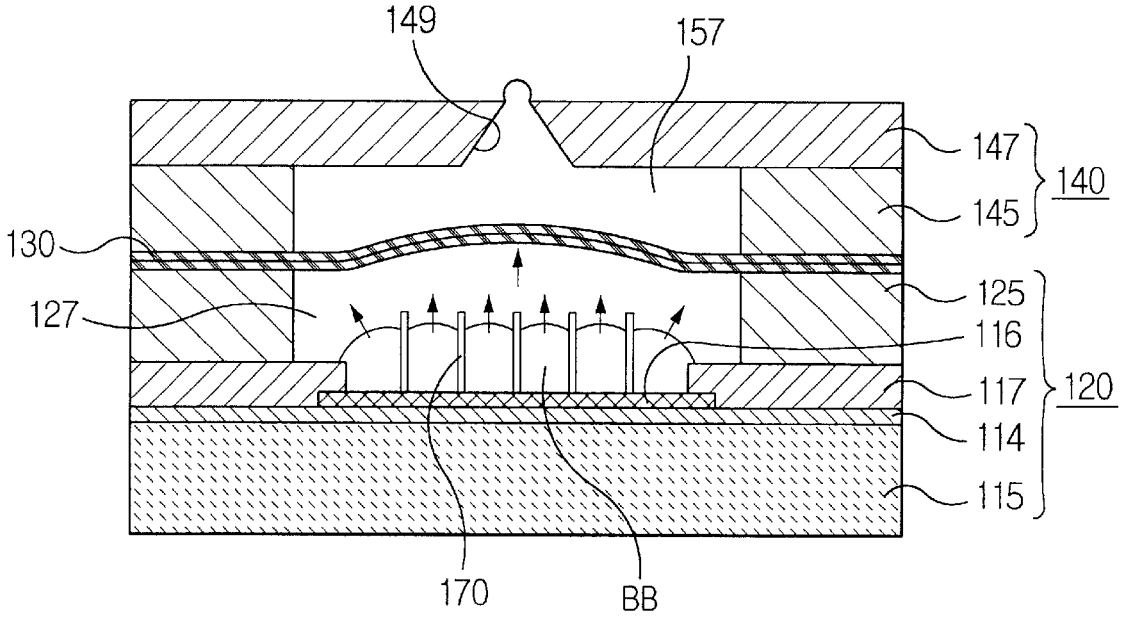
FIGS. 8 to 10 are views for explaining the operation of the ink jetting apparatus shown in FIG.4.
Figure 9:
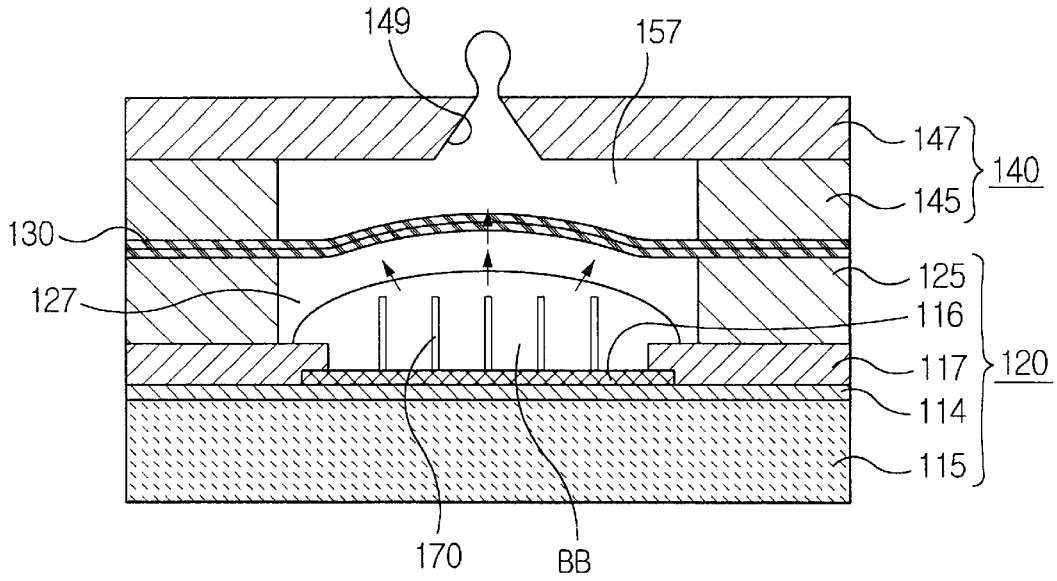
Figure 10:
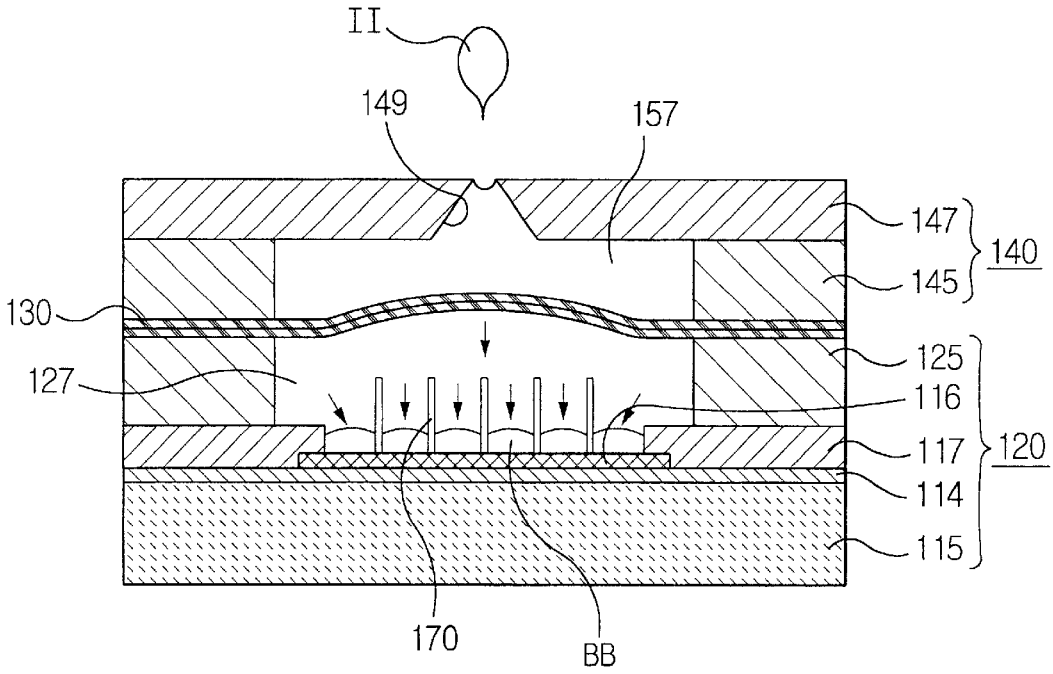

FIGS. 8 to 10 show the operation in a sequential manner of the ink jetting apparatus according to the present invention. As electricity is supplied to heater 116 through conductor 117, the working fluid in working fluid chamber 127 is heated, thereby forming bubbles BB. Here, bubbles BB are produced by the combination of homogeneous and heterogeneous nucleation mechanisms. That is, bubbles BB are produced by the homogeneous nucleation at the area heated by heater 116, while bubbles BB are produced by a heterogeneous nucleation mechanism at the corners of the area where heater 116 and fins 170 are in contact with each other.

Since the space in working fluid chamber 127 is divided into a plurality of areas by fins 170, bubbles BB are produced from the respective divided areas as shown in FIG. 8, and grow while heater 116 keeps generating heat. In a case that the maximum expansion of bubbles BB is lower than the height of fins 170, as shown in FIG. 8, the expansion of bubbles BB is completed in a state that bubbles BB are separately formed on the respective areas. When the maximum expansion of the bubbles is higher than the height of fins 170, as shown in FIG. 9, a united bubble, which is higher than fins 170, is produced. The united bubble shown in FIG. 9 is also produced when fins 170 are heated by heater 116 to a temperature higher than the homogeneous nucleation temperature since the bubbles are produced at the contact area of fins 170 and the working fluid.

By the expanding force of bubble BB, membrane 130 is upwardly bent. Accordingly, the pressure in ink chamber 157 increases. The ink in ink chamber 157 is then jetted through nozzle hole 149. When the electricity supply to heater 116 is ceased, the working fluid is cooled, and the bubble contracts. Accordingly, membrane 130 recovers its initial state, and ink droplet II is jetted outward as shown in FIG. 10. During the contraction of the bubble BB, as shown in FIG. 10, bubble is divided into a plurality of bubbles which respectively contract and disappear.

As described, while the bubble is contracting, since the bubble having a low heat conductivity is divided into a plurality of bubbles, the heating surface area of the bubble is increased, and heat is released through the substrate. Accordingly, the bubble disappears rapidly, and the driving frequency of the ink jetting apparatus is improved. Also, the ink jetting apparatus is more stably driven.

Further, since the bubbles are produced by a heterogeneous nucleation mechanism at the contact area of the fins and the heater, there is an additional advantage of having the initial production of the bubbles at the desired area. In such an ink jetting apparatus, it is preferable that fins 170 are made thin as possible. If the fins are thick, the heat from the heater is absorbed in the fins which means the heater has to generate more heat. Further, for the same reason, the size of the fins should be limited. Accordingly, it is preferable that the height of the fins does not exceed 70% of the height of the working fluid chamber, i.e., the distance between heater 116 and membrane 130, and more preferably, that fins 170 should have a height corresponding to 50% of the height of working fluid chamber 127.

Figure 11:
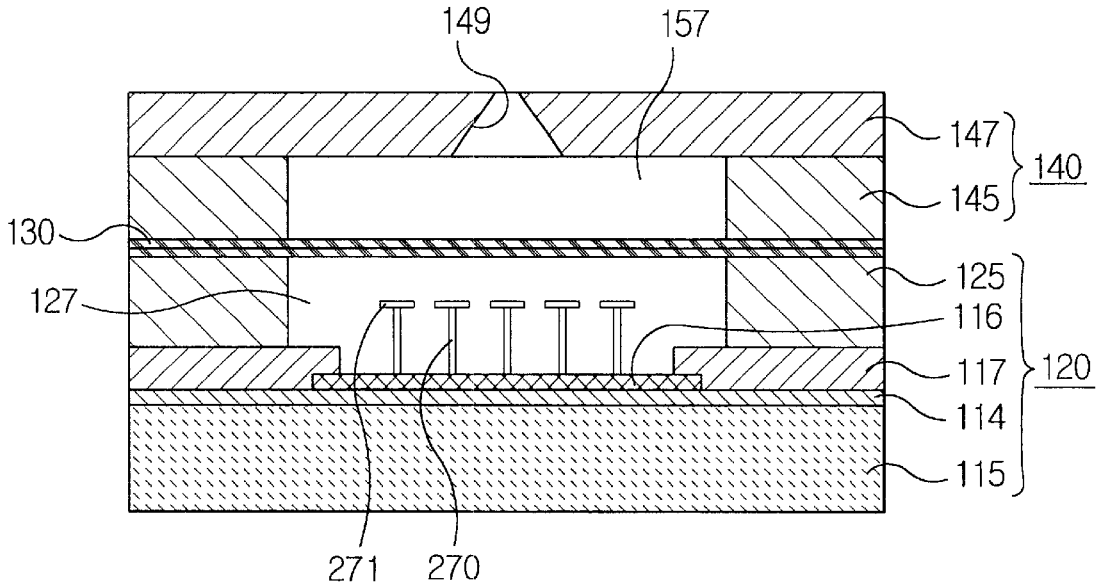
FIG. 11 is a sectional view of an ink jetting apparatus according to another preferred embodiment of the present invention.

FIG. 11 shows another preferred embodiment. According to this embodiment, plate shaped fins 270 are also parallel-disposed on heater 116 as described earlier. However, horizontally extending portions 271 are located on the upper portions of fins 270. Due to the presence of extending portions 271, the contact area of the bubbles and the fins is enlarged. Accordingly, the bubbles disappear more rapidly. The fins having extending portions 271 may be arranged in horizontal, vertical, or latticed arrangements, as described with reference to FIGS. 5 to 7.

FIGS. 12 to 15 illustrate a manufacturing process for the ink jetting apparatus having fins according to the present invention.

Figure 12:
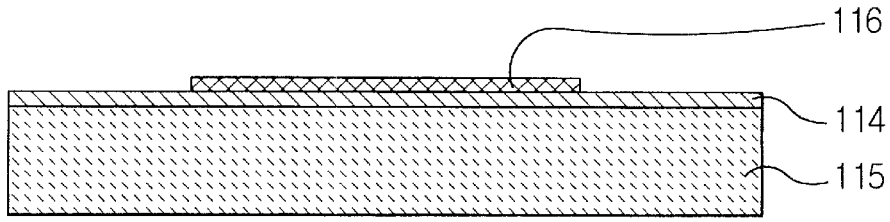
FIGS. 12 to 15 are views for showing a manufacturing process for the ink jetting apparatus according to the present invention in a sequential manner.
Figure 13:
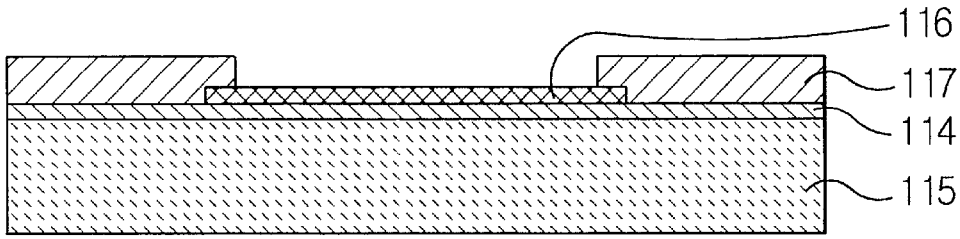

First, as shown in FIG. 12, on oxide film 114 laminated on substrate 115, heater 116 is patterned through a photolithography process. The heater is made of material such as TaA1 is or Si chemical compounds, and has a height of 4000±400 Å. Upon completion of heater 116, as shown in FIG. 13, conductor 117 is patterned through a photolithography process. The conductor is made of metals such as aluminum, copper, nickel, silver, gold, etc., and has a height of 7000±700 Å.

Figure 14:
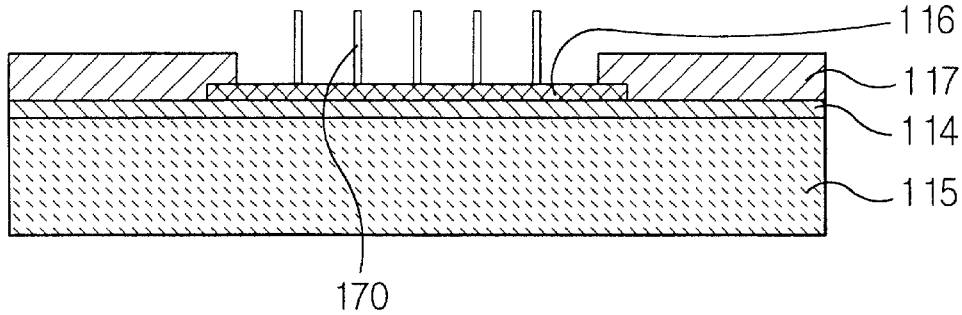
Figure 15:
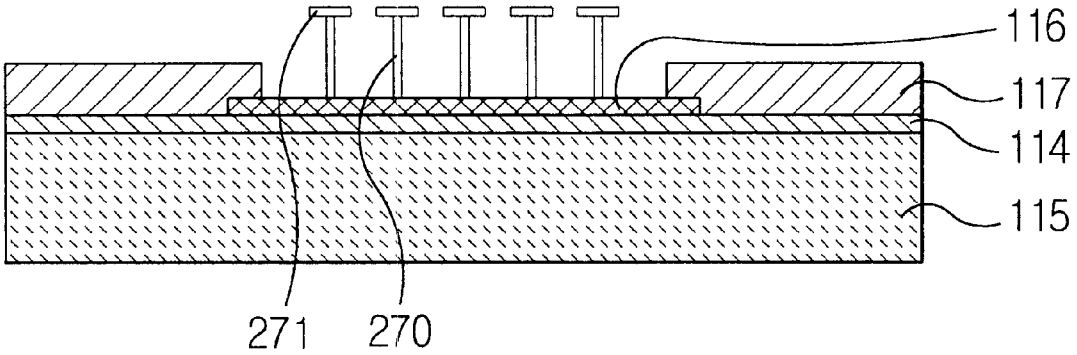

After completion of conductor 117, as shown in FIG. 14, fins 170 are patterned by a photolithography process. The fins are made of metals such as aluminum, copper, nickel, silver, gold, etc., and have a height corresponding to 50% of the height of working fluid chamber 127. Meanwhile, in order to obtain fins 270 having extending portions 271, as shown in FIG. 15, a photolithography process is performed to locate extending portions 271 on fins 270 after completion of fins 270.

After completion of fins 270, working fluid barrier 125 made of polyamide, membrane 130 made of silicon rubber or polyamide, ink chamber barrier 145 made of polyamide or photosensitive dry film, and nozzle plate 147 made of nickel or polyamide are sequentially stacked on one another. That completes the ink jetting apparatus of the present invention.

Since the bubble is divided into a plurality of bubbles by a plurality of fins disposed on the heater, the bubbles disappear rapidly. Accordingly, a high-speed driving of the ink jetting apparatus becomes possible, and the ink jetting apparatus is more stably driven.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

What is claimed is:

1. In a thermal-compression type ink jetting apparatus comprising:

a nozzle module having an ink chamber for reserving ink, and a nozzle hole in the ink chamber for permitting ink to be jetted therethrough;

a driving module adjacent to the nozzle module, said driving module having a working fluid chamber charged with the working fluid, and an electric heater disposed in the working fluid chamber for heating fluid in the working fluid chamber; and a membrane between the ink chamber and the working fluid chamber, the membrane adapted to be pressed into the ink chamber by pressure of a bubble formed when the heater heats the working fluid and thereby jets the ink in the ink chamber through the nozzle hole;

the improvement comprising:

a plurality of fin elements disposed on the heater for conducting heat away from the heater, said fin elements disposed in a manner such that they force bubble formation in the working fluid chamber to occur as formation of a plurality of small bubbles which disappear rapidly rather than as formation of a single large bubble which disappears slowly.

2. The ink jetting apparatus of claim 1, wherein the fin elements are arranged on the heater in a manner such that fin temperature remains sufficiently low to prevent formation of bubbles by a homogeneous nucleation mechanism in portions of the working fluid that are in contact with the fin elements, while heater temperature is allowed to reach a level such that bubble formation occurs by a heterogeneous nucleation mechanism in portions of the working fluid that are in contact with the heater.

3. The ink jetting apparatus of claim 1, wherein the fin elements are arranged on the heater in a lattice pattern.

4. In a thermal-compression type ink jetting apparatus comprising: a nozzle module having an ink chamber for reserving ink, and a nozzle hole in the ink chamber for permitting ink to be jetted therethrough;

a driving module adjacent to the nozzle module, said driving module having a working fluid chamber charged with the working fluid, and an electric heater disposed in the working fluid chamber for heating fluid in the working fluid chamber; and a membrane between the ink chamber and the working fluid chamber, the membrane adapted to be pressed into the ink chamber by pressure of a bubble formed when the heater heats the working fluid and thereby jets the ink in the ink chamber through the nozzle hole;

the improvement comprising:

at least one fin disposed on the heater for conducting heat away from the heater, the at least one fin having a height less than 70% of a distance between the heater and the membrane.

5. The ink jetting apparatus of claim 4, wherein the at least one fin is made of a metal selected from the group consisting of aluminum, copper, nickel, silver, and gold.

6. The ink jetting apparatus of claim 4, wherein the fins have a height of about half of a distance between the heater and the membrane.

7. A method for causing bubbles in a thermal-compression inkjet printer, said printer having a fluid chamber in which a working fluid is heated by an electrically powered heater, to disappear more rapidly upon ceasing electric power supply to the heater, said method comprising disposing a plurality of fin elements on the heater and conducting heat away from the heater via the fin elements, said fin elements disposed in a manner such that they force bubble formation in the working fluid chamber to occur as formation of a plurality of small bubbles which disappear rapidly rather than as formation of a single large bubble which disappears slowly.

8. The method of claim 7, wherein said fin elements are disposed in a manner such that fin temperature remains sufficiently low to prevent formation of bubbles by a homogeneous nucleation mechanism in portions of the working fluid that are in contact with the fin elements, while heater temperature is allowed to reach a level such that bubble formation occurs by a heterogeneous nucleation mechanism in portions of the working fluid that are in contact with the heater.

9. In a process for manufacturing a thermal-compression inkjet printer apparatus, said process comprising:

(1) providing a nozzle having an ink chamber for reserving ink, and a nozzle hole in the ink chamber for permitting ink to be jetted therethrough;

(2) providing a driving module adjacent to the nozzle module, said driving module having a working fluid chamber charged with the working fluid, and an electric heater disposed in the working fluid chamber for heating fluid in the working fluid chamber; and (3) providing a membrane between the ink chamber and the working fluid chamber, the membrane adapted to be pressed into the ink chamber by pressure of a bubble formed when the heater heats the working fluid and thereby jets the ink in the ink chamber through the nozzle hole;

the improvement comprising:

disposing on the heater a plurality of fin elements for conducting heat away from the heater, said fin elements disposed in a manner such that said fin elements force bubble formation in the working fluid chamber to occur as formation of a plurality of small bubbles which disappear rapidly rather than as formation of a single large bubble which disappears slowly.

10. The process of claim 9, wherein the fin elements are arranged on the heater in a manner such that fin temperature remains sufficiently low to prevent formation of bubbles by a homogeneous nucleation mechanism in portions of the working fluid that are in contact with the fin elements, while heater temperature is allowed to reach a level such that bubble formation occurs by a heterogeneous nucleation mechanism in portions of the working fluid that are in contact with the heater.

11. The process of claim 10, wherein the fin elements are arranged on the heater in a lattice pattern.

12. The process of claim 9, wherein the at least one fin is made of a metal selected from the group consisting of aluminum, copper, nickel, silver, and gold.

13. In a process for manufacturing a thermal-compression inkjet printer apparatus, said process comprising:

(1) providing a nozzle having an ink chamber for reserving ink, and a nozzle hole in the ink chamber for permitting ink to be jetted therethrough;

(2) providing a driving module adjacent to the nozzle module, said driving module having a working fluid chamber charged with the working fluid, and an electric heater disposed in the working fluid chamber for heating fluid in the working fluid chamber; and (3) providing a membrane between the ink chamber and the working fluid chamber, the membrane adapted to be pressed into the ink chamber by pressure of a bubble formed when the heater heats the working fluid and thereby jets the ink in the ink chamber through the nozzle hole;

the improvement comprising:

disposing on the heater at least one fin for conducting heat away from the heater, said fin having a height less than 70% of a distance between the heater and the membrane.

14. The process of claim 13, wherein the fins have a height of about half of a distance between the heater and the membrane.

* * * * *